US008840415B2

(12) United States Patent
Orris et al.

(10) Patent No.: US 8,840,415 B2
(45) Date of Patent: Sep. 23, 2014

(54) POWER CABLE CONNECTOR

(75) Inventors: David Patrick Orris, Middletown, PA (US); Daniel Yi, Harrisburg, PA (US); Richard Grzybowski, Palmyra, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 253 days.

(21) Appl. No.: 13/253,472

(22) Filed: Oct. 5, 2011

(65) Prior Publication Data

US 2013/0089997 A1 Apr. 11, 2013

(51) Int. Cl.

| | |
|---|---|
| ***H01R 13/62*** | (2006.01) |
| ***H01R 13/33*** | (2006.01) |
| ***H01R 12/59*** | (2011.01) |
| ***H01R 13/627*** | (2006.01) |
| ***H01R 13/02*** | (2006.01) |
| *H01R 13/506* | (2006.01) |

(52) U.S. Cl.

CPC ..... *H01R 12/592* (2013.01); *H01R 13/33* (2013.01); *H01R 13/6272* (2013.01); *H01R 13/025* (2013.01); *H01R 13/506* (2013.01)

USPC ..... 439/329; 439/495

(58) Field of Classification Search

USPC ..... 439/492–499, 329, 260, 374

See application file for complete search history.

(56) References Cited

U.S. PATENT DOCUMENTS

| | | | | | |
|---|---|---|---|---|---|
| 3,149,897 | A | * | 9/1964 | Martineck | 439/494 |
| 3,154,365 | A | * | 10/1964 | Crimmins | 439/496 |
| 3,897,130 | A | * | 7/1975 | Donnelly et al. | 439/496 |
| 3,941,448 | A | * | 3/1976 | Evans | 439/493 |
| 4,740,867 | A | * | 4/1988 | Roberts et al. | 439/499 |
| 4,963,098 | A | * | 10/1990 | Myer et al. | 439/76.1 |
| 5,240,420 | A | * | 8/1993 | Roberts | 439/62 |
| 5,385,478 | A | * | 1/1995 | Niekawa | 439/67 |
| 5,397,247 | A | * | 3/1995 | Aoki et al. | 439/496 |
| 5,431,576 | A | | 7/1995 | Matthews | |
| 5,549,479 | A | * | 8/1996 | Elco et al. | 439/67 |
| 5,954,536 | A | * | 9/1999 | Fuerst et al. | 439/493 |
| 5,967,831 | A | * | 10/1999 | Yamada et al. | 439/496 |
| 6,010,359 | A | * | 1/2000 | Etters et al. | 439/496 |
| 6,062,900 | A | * | 5/2000 | Juntwait | 439/495 |

(Continued)

FOREIGN PATENT DOCUMENTS

| | | | |
|---|---|---|---|
| EP | 0908975 | A1 | 4/1999 |
| EP | 1737074 | A2 | 12/2006 |
| WO | 2010119905 | A1 | 10/2010 |

OTHER PUBLICATIONS

International Search Report. International Application No. PCT/US2012/056193, International Filing Date Sep. 20, 2012.

(Continued)

*Primary Examiner* — Briggitte R Hammond

(57) ABSTRACT

A power cable connector includes a housing having a mating end and a cable end. The housing has a chamber extending between the mating end and the cable end. The housing has an engagement feature configured to engage a socket connector extending from a substrate. A flat cable is received in the chamber. The flat cable extends from the cable end. The flat cable has a mating portion extending from the mating end. The mating portion is configured to be received in the socket connector such that the flat cable directly engages a power terminal of the socket connector.

19 Claims, 5 Drawing Sheets

(56) References Cited

U.S. PATENT DOCUMENTS

| | | | | |
|---|---|---|---|---|
| 6,176,734 | B1 * | 1/2001 | Juntwait et al. | 439/493 |
| 6,193,544 | B1 * | 2/2001 | McGinnis | 439/492 |
| 6,464,534 | B1 * | 10/2002 | Schramme et al. | 439/492 |
| 6,558,186 | B1 * | 5/2003 | LePottier et al. | 439/496 |
| 6,626,698 | B2 * | 9/2003 | Matsumura | 439/496 |
| 6,749,459 | B2 * | 6/2004 | Koch et al. | 439/496 |
| 6,932,642 | B2 * | 8/2005 | Beer et al. | 439/495 |
| 7,048,573 | B2 * | 5/2006 | Masaki et al. | 439/492 |
| 7,077,689 | B2 * | 7/2006 | Holzle et al. | 439/494 |
| 7,371,093 | B1 * | 5/2008 | Johnson | 439/260 |
| 7,682,184 | B2 * | 3/2010 | Ko et al. | 439/495 |
| 2003/0236025 | A1 * | 12/2003 | Wu | 439/495 |
| 2004/0002255 | A1 * | 1/2004 | Ueda et al. | 439/495 |
| 2004/0110412 | A1 * | 6/2004 | Ueda | 439/495 |
| 2004/0224555 | A1 * | 11/2004 | Singh et al. | 439/495 |
| 2008/0009180 | A1 * | 1/2008 | Ikuta et al. | 439/495 |

OTHER PUBLICATIONS

Crown Clip Series Sockets; Catalog 1773096; Revised Feb. 2010; Tyco Electronics Corporation; 11 pgs.

* cited by examiner

POWER CABLE CONNECTOR

BACKGROUND OF THE INVENTION

The subject matter herein relates generally to power connector systems.

Power connector systems, such as those used in the data communication field, typically include a busbar for supplying power to multiple cards or modules in the data communication system. The busbar typically includes a power connector mounted to the busbar. Other power connectors are terminated to the busbar power connectors. Such power connectors may be terminated to an end of a power cable and include a blade that is plugged into the busbar power connector.

Known cable mounted power connectors are not without disadvantages. Such power connectors require an electrical connection between the blade and the power cable. The components and assembly time to create such interface add materials and assembly time to the connector. Such power connectors require mounting hardware for connecting to the busbar power connector. Such connectors are not blind matable. Such connectors are not separable from the busbar power connectors.

A need remains for a power connector that creates a cost effective and reliable power connection between a busbar connector and the power cable of such power connector. A need remains for a separable power connector. A need remains for a blind-matable power connector.

BRIEF DESCRIPTION OF THE INVENTION

In one embodiment, a power cable connector is provided including a housing having a mating end and a cable end. The housing has a chamber that extends between the mating end and the cable end. The housing has an engagement feature that is configured to engage a socket connector that extends from a substrate. A flat cable is received in the chamber. The flat cable extends from the cable end. The flat cable has a mating portion that extends from the mating end. The mating portion is configured to be received in the socket connector such that the flat cable directly engages a power terminal of the socket connector.

In another embodiment, a power connector system is provided having a socket connector that is configured to be mounted to a substrate. The socket connector has a socket housing that has a socket. The socket connector has a power terminal that is received in the socket housing and exposed in the socket. The power terminal is configured to be terminated to the substrate. A power cable connector is coupled to the socket connector. The power cable connector includes a housing that has a mating end and a cable end. The housing has a chamber that extends between the mating end and the cable end. The housing has an engagement feature that engages the socket connector. The power cable connector includes a flat cable received in the chamber. The flat cable extends from the cable end. The flat cable has a mating portion that extends from the mating end. The mating portion is received in the socket such that the flat cable directly engages the power terminal of the socket connector.

In a further embodiment, a power connector system is provided that includes a socket connector that is configured to be mounted to a substrate. The socket connector has a socket housing that has a socket. The socket connector has a power terminal that is received in the socket housing and exposed in the socket. The power terminal is configured to be terminated to the substrate. The power connector system also includes a power cable connector is mounted to a panel that is movable toward and away from the socket connector. The power cable connector includes a housing that has a mating end and a cable end. The housing has a chamber that extends between the mating end and the cable end. The housing has an engagement feature that engages the socket connector when the panel is moved toward the socket connector. The power cable connector includes a flat cable that is received in the chamber. The flat cable extends from the cable end. The flat cable has a mating portion that extends from the mating end. The mating portion is received in the socket when the panel is moved toward the socket connector such that the flat cable directly engages the power terminal of the socket connector. The power cable connector is configured to float with respect to the panel within a floating window.

DETAILED DESCRIPTION OF THE INVENTION

Figure 1:
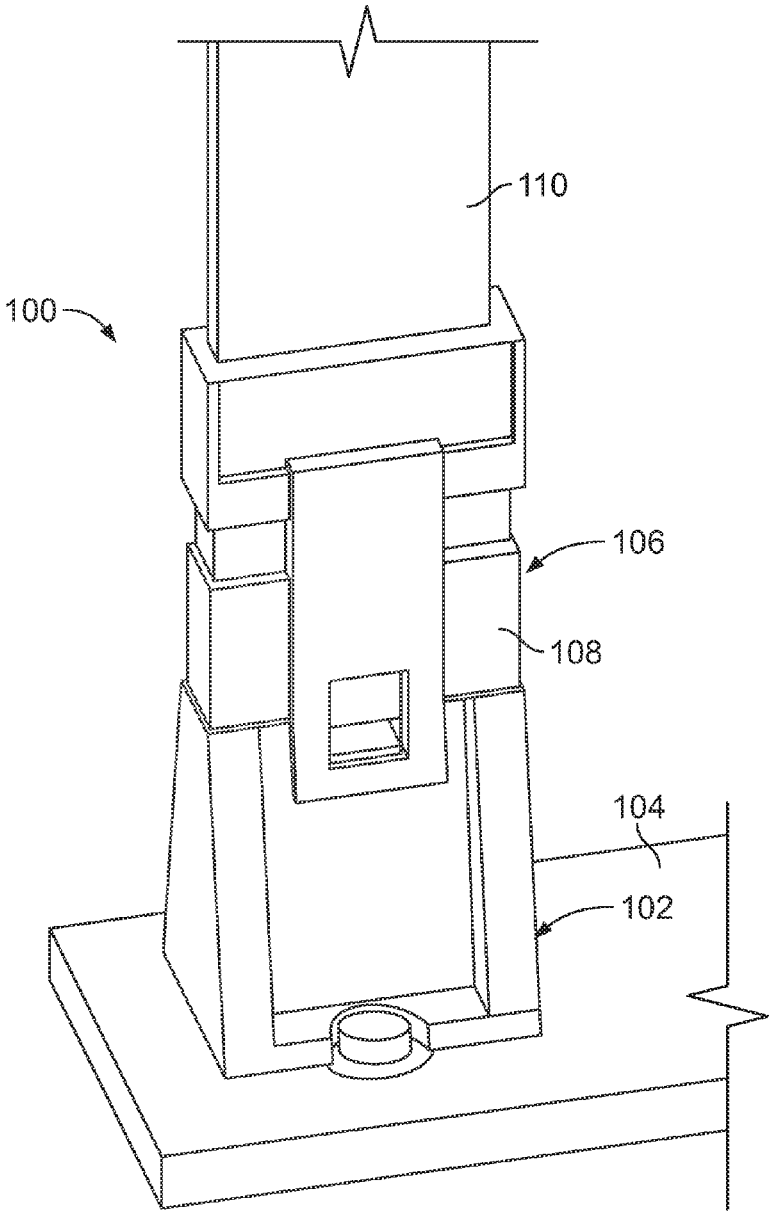
FIG. 1 illustrates a power connector system formed in accordance with an exemplary embodiment.

FIG. 1 illustrates a power connector system 100 formed in accordance with an exemplary embodiment. The power connector system 100 includes a socket connector 102 mounted to a substrate 104. In the illustrated embodiment, the socket connector 102 is a busbar connector and may be referred to hereinafter as busbar connector 102. Other types of socket connectors 102 may be used in alternative embodiments. In the illustrated embodiment, the substrate 104 is a busbar and may be referred to hereinafter as busbar 104. Other types of substrates 104 may be used to power the socket connector 102.

The power connector system 100 includes a power cable connector 106 coupled to the busbar connector 102. The power cable connector 106 includes a housing 108 coupled to an end of a flat cable 110. Power is transmitted between the busbar 104 and the cable 110 via the busbar connector 102. The power cable connector 106 allows the cable 110 to be coupled directly to the busbar connector 102 at a separable interface.

Figure 2:
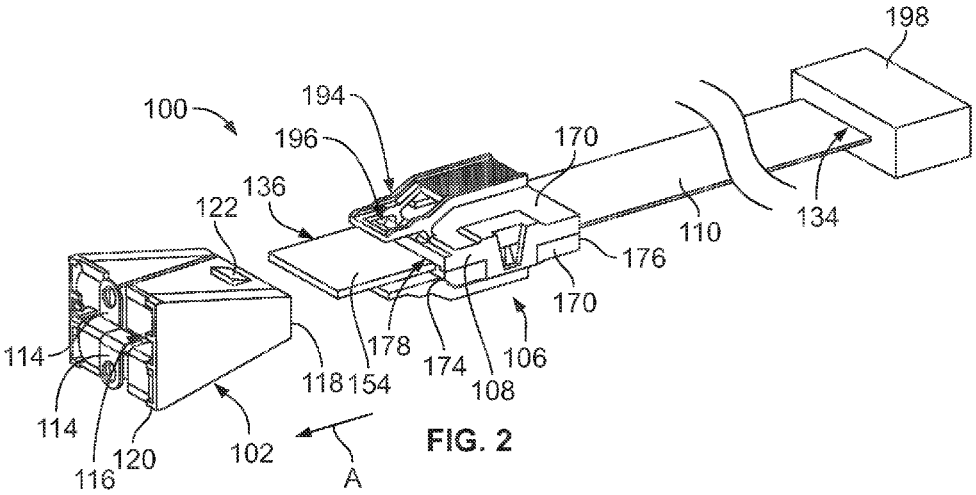
FIG. 2 is front perspective view of a power cable connector and a busbar connector of the power connector system (shown in FIG. 1).
Figure 3:
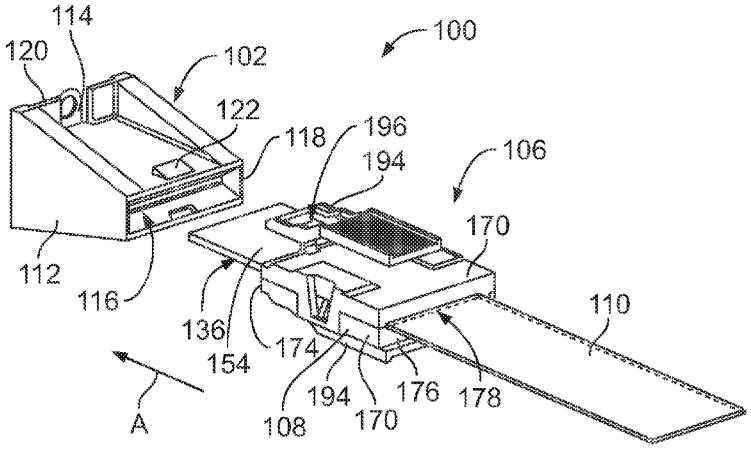
FIG. 3 is a rear perspective view of the power cable connector and the busbar connector shown in FIG. 2.

FIG. 2 is front perspective view of the power connector system 100 showing the power cable connector 106 poised for coupling to the busbar connector 102. FIG. 3 is a rear perspective view of the power connector system 100 showing the power cable connector 106 poised for mating with the busbar connector 102.

The busbar connector 102 includes a socket housing 112 holding a pair of power terminals 114. The socket housing 112 may hold any number of power terminals 114. The power terminals 114 are electrically connected to the busbar 104 (shown in FIG. 1). The power terminals 114 are electrically connected to the cable 110 (shown in FIG. 1) when the power cable connector 106 is mated with the busbar connector 102.

The socket housing 112 has a socket 116 that receives the power terminals 114 and receives the cable 110. The cable 110 is directly coupled to the power terminals 114 within the socket 116. The power terminals 114 are received in the socket housing 112 and are exposed in the socket 116. The socket 116 is open at a mating end 118 of the socket housing 112. In an exemplary embodiment, the socket 116 has a chamfered lead in at the mating end 118 for guiding the cable 110 into the socket 116.

The socket housing 112 has a base 120 opposite the mating end 118. The base 120 is configured to be mounted to the busbar 104. In an exemplary embodiment, the power terminals 114 are loaded into the socket housing 112 through the base 120. The socket housing 112 includes engagement features 122 configured to engage the power cable connector 106 when the power cable connector 106 is mated to the busbar connector 102.

Figure 4:
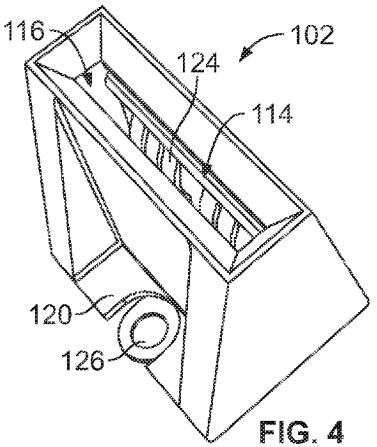
FIG. 4 illustrates the busbar connector shown in FIGS. 1 and 2.

FIG. 4 illustrates the busbar connector 102. The power terminal 114 is shown in FIG. 4. The power terminal 114 includes a plurality of spring beams 124 that are configured to engage the cable 110 (shown in FIG. 1) when the cable 110 is loaded into the socket 116. The spring beams 124 are deflectable and are configured to be spring biased against the cable 110 when loaded therein. Optionally, the socket 116 may be sized to receive a range of different sized cables 110. For example, cables having different thicknesses may be loaded into the socket 116, wherein the different sized cables 110 are configured to be engaged by the spring beams 124 to ensure electrical connection between the power terminals 114 and the cable 110. The socket 116 may also be wider than the cable 110 to allow the cable 110 to float within the socket 116. Multiple spring beams 124 are provided to ensure that the power terminal 114 engages the cable 110 when the cable 110 is at different lateral (e.g. side-to-side) positions within the socket 116.

The power terminals 114 have mounting features 126 for securing the power terminals 114 to the busbar 104. The mounting features 126 are provided at the base 120, however the mounting features 126 may be at other locations in alternative embodiments. In the illustrated embodiment, the mounting features 126 constitute openings that receive fasteners therethrough to mechanically and electrically connect the power terminals 114 to the busbar 104. Other types of mounting features may be used in alternative embodiments, such as solder pads.

Figure 5:
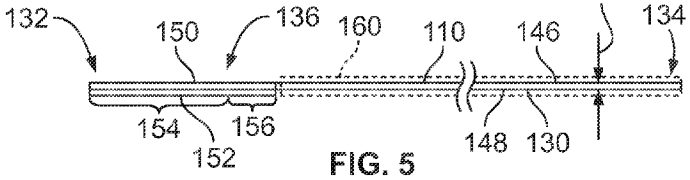
FIG. 5 is a side view of a cable of the power cable connector shown in FIGS. 2 and 3.
Figure 6:
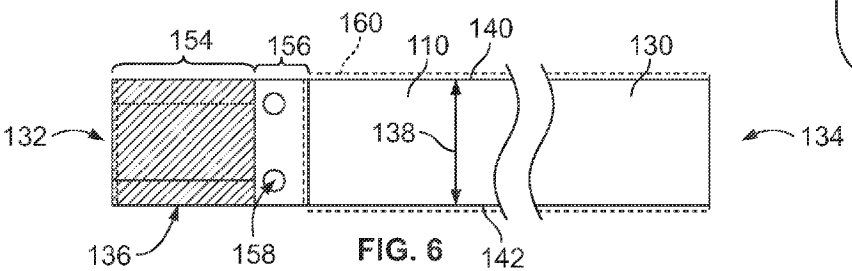
FIG. 6 is a top view of the cable shown in FIG. 5.

FIG. 5 is a side view of the cable 110. FIG. 6 is a top view of the cable 110. The cable 110 is a flat, flexible cable. The cable 110 has a main body 130 extending longitudinally for a length between opposite first and second ends 132, 134. The cable 110 defines a mating portion 136 at the first end 132. The mating portion 136 is the portion of the cable 110 that is loaded into the busbar connector 102 (shown in FIG. 1).

In an exemplary embodiment, the cable 110 has a rectangular cross-section. The cable 110 has a width 138 measured between first and second sides 140, 142 of the cable 110. The cable 110 has a thickness 144 measured between a first planar surface 146 and a second planar surface 148. In an exemplary embodiment, the first and second planar surfaces 146, 148 have substantially similar widths. In an exemplary embodiment, the width 138 is significantly greater than the thickness 144. For example, the width 138 may be at least ten times the thickness 144.

In an exemplary embodiment, the cable 110 is folded over at the mating portion 136 such that the mating portion 136 of the cable 110 is at least twice as thick as the other portions of the main body 130. Optionally, the cable 110 may be folded over multiple times at the mating portion 136. In other embodiments, the cable 110 may not be folded over, but rather the mating portion 136 has the same thickness as the other portions of the main body 130. In the illustrated embodiment, the cable 110 is folded over one time such that the mating portion 136 defines a first layer 150 and a second layer 152. By folding over the cable 110 at the mating portion 136, the first planar surface 146 is exposed on both sides of the mating portion 136. The second planar surface 148 engages itself at the interface between the first and second layers 150, 152.

In an exemplary embodiment, the mating portion 136 includes both an exposed section 154 and an encased section 156. The exposed section 154 is the section of the mating portion 136 that extends beyond the housing 108 (shown in FIG. 1). The encased section 156 is the section of the mating portion 136 that is located within the housing 108. The exposed section 154 is configured to be received in the socket 116 (shown in FIG. 2). The exposed section 154 may be plated, while the encased section 156 may remain unplated.

In an exemplary embodiment, the cable 110 includes openings 158 through the first and second layers 150, 152 in the encased section 156. The openings 158 receive a portion of the housing 108 to secure the cable 110 within the housing 108. Other features may be provided in alternative embodiments to secure the cable 110 and the housing 108 together.

Optionally, a sleeve or coating 160 may cover the portion of the cable 110 rearward of the mating portion 136. The sleeve may electrically isolate the cable 110 to avoid inadvertent touching of the cable 110. The sleeve does not cover the mating portion 136, particularly at the exposed section 154, such that the exposed section 154 remains uncovered and exposed for direct engagement with the power terminal 114 (shown in FIG. 2).

Figure 7:
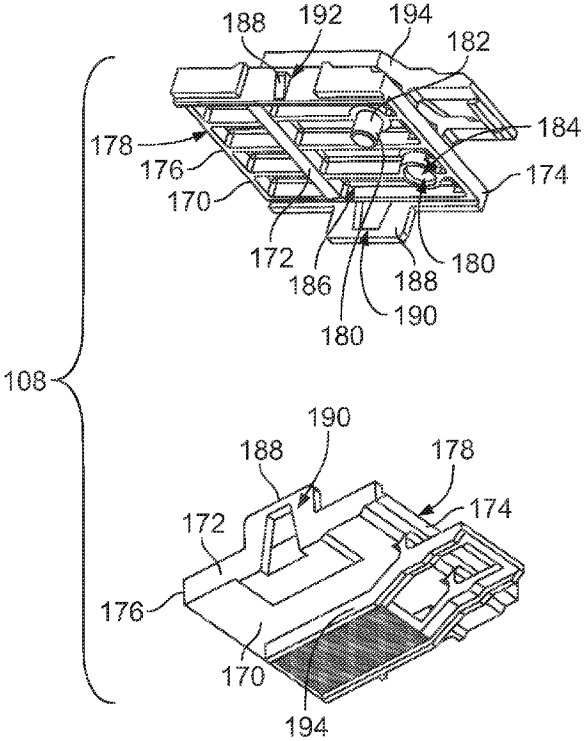
FIG. 7 is an exploded view of a housing of the power cable connector shown in FIGS. 2 and 3.

FIG. 7 is an exploded view of the housing 108 (shown in FIG. 1). The housing 108 is formed by a pair of shells 170 that are coupled together. In an exemplary embodiment, the shells 170 are identical with one shell 170 being inverted with respect to the other shell 170. The shells 170 define an upper shell and a lower shell, with the cable 110 being configured to be sandwiched between the upper and lower shells. In an exemplary embodiment, the housing 108 may be formed from different shells coupled together rather than identical shells 170 coupled together. The housing 108 may be formed from more or less than two pieces in alternative embodiments.

Each shell 170 includes a dielectric body 172 extending between a mating end 174 and a cable end 176. The shells 170 defines a chamber 178 of the housing 108 in an interior of the housing 108. The chamber 178 extends between the mating end 174 and the cable end 176. The cable 110 (shown in FIG. 1) is configured to be received in the chamber 178. Each shell 170 includes cable securing features 180 used to secure the cable 110 within the chamber 178. In the illustrated embodiment, the cable securing features 180 include a post 182 and an opening 184. The posts 182 of the shells 170 are configured to be received in corresponding openings 158 in the cable 110. When the two shells 170 are coupled together to form the housing 108, the post 182 of one shell 170 is received in the opening 184 of the other shell 170. Other types of cable securing features 180 may be used in alternative embodiments.

The shells 170 include channels 186 that are open to the chamber 178. The channels 186 define air pockets around the cable 110 to help dissipate heat generated by the cable 110.

The shells 170 include securing features 188 used to secure the two shells 170 together. In an exemplary embodiment, the securing feature 188 on one side of the shell 170 constitutes a latch 190 while the securing feature 188 on the other side of the shell 170 constitutes a catch 192. When the two shells 170 are coupled together to form the housing 108, the latch 190 of each shell 170 engages the catch 192 of the other shell 170 to secure the two shells 170 together. Other types of securing features 188 may be used in alternative embodiments.

Each shell 170 includes an engagement feature 194 configured to engage the busbar connector 102 (shown in FIG. 1) to secure the power cable connector 106 to the busbar connector 102. In the illustrated embodiment, the engagement feature 194 constitutes a deflectable latch however other types of engagement features may be used in alternative embodiments.

Returning to FIGS. 2 and 3, the power cable connector 106 is illustrated in an assembled state. The two shells 170 define upper and lower shells that are coupled together to form the housing 108. In an exemplary embodiment, two identical shells 170 are used to form the housing 108. The two shells 170 are hermaphroditic to allow the identical shells 170 to be coupled together. When the housing 108 is assembled, the mating ends 174 of the shells 170 define a mating end of the housing 108, which may be referred to hereinafter as the mating end 174 of the housing 108. The cable ends 176 of the shells 170 define a cable end of the housing 108, which may be referred to hereinafter as the cable end 176 of the housing 108.

The chamber 178 of the housing 108 receives the cable 110. The cable 110 is sandwiched between the upper and lower shells 170. When the shells 170 are coupled together to form the housing 108, the posts 182 (shown in FIG. 7) extend through the openings 158 (shown in FIG. 6) of the cable 110 to secure the cable 110 within the housing 108. The cable 110 extends entirely through the housing 108 such that part of the cable 110 extends rearward of the cable end 176 and part of the cable 110 extends forward of the mating end 174. For example, the exposed section 154 of the mating portion 136 of the cable 110 is the section of the cable 110 that extends forward from housing 108. The mating portion 136 extends forward of the housing 108 such that the mating portion 136 may be loaded into the socket 116 to mate with the power terminals 114. During mating, the power cable connector 106 is coupled to the busbar connector 102 in the direction of arrow A. The socket 116 is sized to receive the mating portion 136 of the cable 110. Optionally, the socket 116 may be oversized allowing slight misalignment of the power cable connector 106 with respect to the busbar connector 102.

When the power cable connector 106 is coupled to the busbar connector 102, the engagement features 194 engage the corresponding engagement features 122 of the busbar connector 102 to secure the power cable connector 106 to the busbar connector 102. The engagement features 194 are releasable from the engagement features 122 such that the power cable connector 106 may be removed from the busbar connector 102. The power cable connector 106 is thus separable from the busbar connector 102 allowing separable and repeatable mating of the power cable connector 106 with the busbar connector 102. Optionally, the engagement features 194 may be latches, wherein rear ends of the latches may be pressed to release the engagement features 194 from the engagement features 122. Each engagement feature 194 includes a window 196. When the engagement feature 194 engages the corresponding engagement feature 122, the engagement feature 122 is received in the window 196. When the engagement feature 122 is received in the window 196, the side-to-side floating of the power cable connector 106 with respect to the busbar connector 102 may be limited, ensuring proper positioning of the power cable connector 106 with respect to the busbar connector 102.

In an exemplary embodiment, a power connector 198 is terminated to the cable 110 proximate to the second end 134 of the cable 110. The cable 110 is flexible between the power connector 198 and the housing 108. The cable 110 may have any length between the power connector 198 and the housing 108. Having the cable 110 flexible allows the cable 110 to be routed between and/or around other components in the system.

The cable 110 is easily manufactured. The cable 110 does not need to be stripped or prepared prior to coupling to the housing 108. The cable 110 provides a large amount of surface area for heat dissipation, which may allow the power connector system 100 to transmit higher currents or operate at a reduced operating temperature. The flexibility of the cable 110 allows the power connector system 100 to fit in confined spaces. The cable 110 may have a low resistance, a low inductance and/or a high capacitance. The cable 110 is directly connected to the power terminals 114 at a separable interface. Other components, such as terminals or contacts, are not provided between the cable 110 and the power terminals 114. The number of mating interfaces between the cable 110 and the busbar 104 is limited to the interfaces between the power terminals 114 and the busbar 104 and the power terminals 114 and the cable 110.

Figure 8:
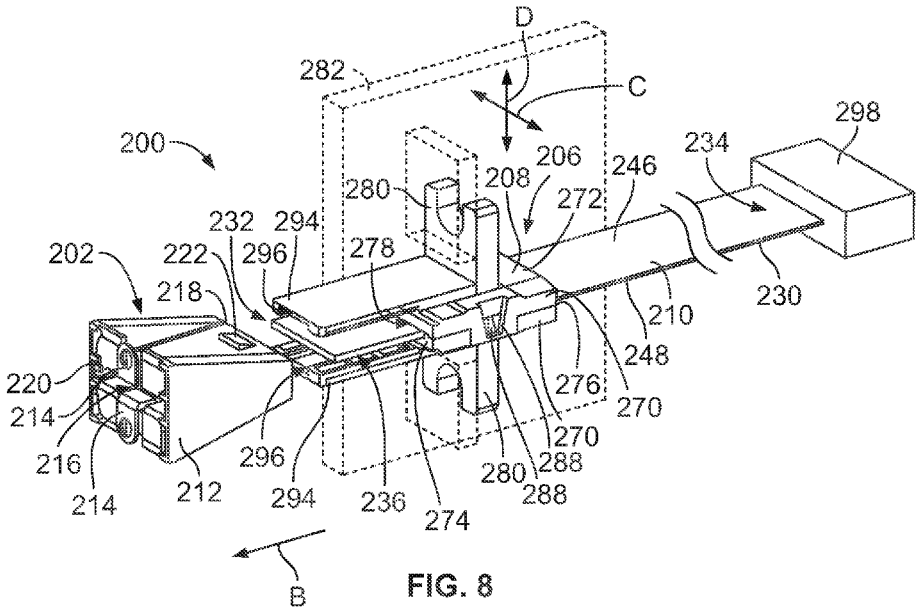
FIG. 8 illustrates a power connector system showing a busbar connector and a power cable connector in accordance with an exemplary embodiment.
Figure 9:
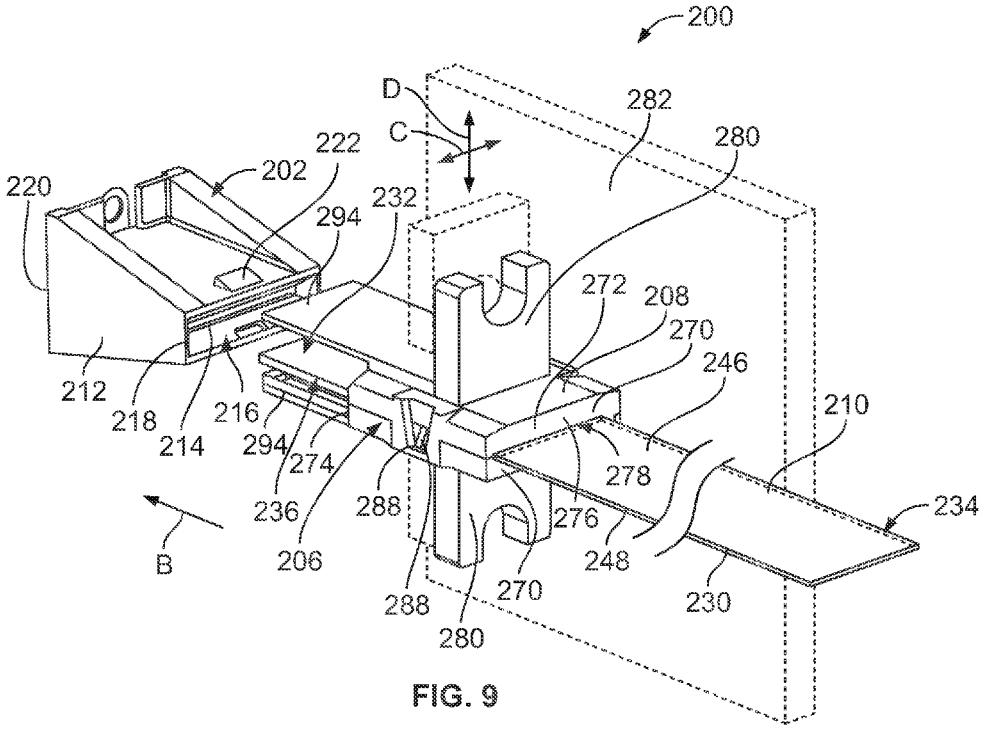
FIG. 9 is a rear perspective view of the power cable connector poised for mating with the busbar connector shown in FIG. 8.

FIGS. 8 and 9 illustrate a power connector system 200 showing a busbar connector 202 and a power cable connector 206. FIG. 8 is a front perspective view of the power connector system 200 showing the power cable connector 206 poised for coupling to the busbar connector 202. FIG. 9 is a rear perspective view of the power connector system 200 showing the power cable connector 206 poised for mating with the busbar connector 202.

The power connector system 200 includes the busbar connector 202, which is configured to be mounted to a busbar, such as the busbar 104 (shown in FIG. 1). The busbar connector 202 may be similar to the busbar connector 102 (shown in FIG. 1). The power cable connector 206 is configured to be coupled to the busbar connector 202. The power cable connector 206 includes a housing 208 coupled to an end of a flat cable 210. The cable 210 may be similar to the cable 110 (shown in FIG. 1). Power is transmitted between the busbar and the cable 210 via the busbar connector 202. The power cable connector 206 allows the cable 210 to be coupled directly to the busbar connector 202 at a separable interface.

The busbar connector 202 includes a socket housing 212 holding a pair of power terminals 214. The power terminals 214 are configured to be electrically connected to the busbar. The power terminals 214 are directly connected to the cable 210 when the power cable connector 206 is mated with the busbar connector 202. The socket housing 212 has a socket 216 open at a mating end 218 of the socket housing 212. The socket housing 212 has a base 220 opposite the mating end 218. The socket housing 212 includes engagement features 222 configured to engage the power cable connector 206.

The cable 210 has a main body 230 extending longitudinally for a length between opposite first and second ends 232, 234. The cable 210 defines a mating portion 236 at the first end 232. The mating portion 236 is the portion of the cable 210 that is loaded into the busbar connector 202. The cable 210 has a thickness measured between a first planar surface 246 and a second planar surface 248. In an exemplary embodiment, the cable 210 is folded over at the mating portion 236. The mating portion 236 extends forward of the housing 208 such that the mating portion 236 may be loaded into the socket 216 to mate with the power terminals 214. During mating, the power cable connector 206 is coupled to the busbar connector 202 in a mating direction in the direction of arrow B. The socket 216 is sized to receive the mating portion 236 of the cable 210. Optionally, the socket 216 may be oversized allowing slight misalignment of the power cable connector 206 with respect to the busbar connector 202.

The housing 208 is formed by a pair of shells 270 that are coupled together. Each shell 270 includes a dielectric body 272 extending between a mating end 274 and a cable end 276. The shells 270 define a chamber 278 of the housing 208 in an interior of the housing 208. The cable 210 is configured to be received in and secured in the chamber 278.

The shells 270 include mounting features 280 used to secure the housing 208 to another component, such as a panel, card, board or other component, designated generally at 282. The panel 282 is movable toward and away from the busbar and the busbar connector 202. The housing 208 is movable with the panel 282 for mating and unmating the power cable connector 206 with the busbar connector 202. Optionally, multiple power cable connectors 206 may be mounted to the panel 282, wherein all of the power cable connectors 206 are movable with the panel 282 for simultaneous mating with corresponding busbar connectors 202, which may or may not be mounted to the same busbar.

In the illustrated embodiment, the mounting features 280 constitute mounts that receive shoulder screws, however other types of mounting features 280 may be used in alternative embodiments. Optionally, the mounting features 280 may be able to float or move slightly with respect to the panel 282 to allow for shifting of the position of the housing 208 with respect to the panel 282. The floating of the housing 208 with respect to the panel 282 allows for corrective alignment of the power cable connector 206 with respect to the busbar connector 202. In an exemplary embodiment, the housing 208 is able to move in at least one direction transverse to the mating direction (arrow B). For example, the housing 208 may be movable in a first lateral direction (arrow C) and/or a second lateral direction (arrow D). The housing 208 is movable in a floating window, which is large enough to accommodate corrective alignment of the power cable connector 206 with respect to the busbar connector 202 for proper mating therebetween. For example, the position of the housing 208 may be corrected without lateral movement of the panel 282 (which may be restricted by the system to only linear movement along the mating direction).

In an exemplary embodiment, the power connector system 200 may be used in a data communication application as part of a server. The server may have a backplane with an associated busbar with multiple busbar connectors 202 mounted thereto. Many cards or modules may be coupled to the backplane, and such cards or modules may require power. One or more power cable connectors 206 may be associated with each card or module. As the cards or modules are plugged into the server and/or backplane, the power cable connectors 206 are coupled to the busbar connectors 202. Optionally, the power cable connectors 206 may be blind-matable because the power cable connectors 206 are not separately held by an installer and plugged into the busbar connectors 202, but rather the power cable connectors 206 are moved with the panel 282 and are coupled to the busbar connectors 202 without individually aligning the power cable connectors 206.

The shells 270 include securing features 288 used to secure the two shells 270 together. The shells 270 include engagement features 294 configured to engage the busbar connector 202 to secure the power cable connector 206 to the busbar connector 202. In the illustrated embodiment, the engagement features 294 constitute arms (which may be referred to hereinafter as arms 294) extending from the mating end 274 along, and spaced apart from, the mating portion 236 of the cable 210. The arms 294 may be parallel to the mating portion 236. The arms 294 have guide slots 296 along interior surfaces thereof that face the mating portion 236. The guide slots 296 receive the engagement features 222 of the socket housing 212, which act as guide features to guide mating of the housing 208 and the busbar connector 202. The guide slots 296 may have a chamfered lead-in. The guide slots 296 may be wider than the width of the engagement features 222 to allow side-to-side floating of the power cable connector 206 with respect to the busbar connector 202. The engagement features 294 are releasable from the engagement features 222 such that the power cable connector 206 may be removed from the busbar connector 202. The power cable connector 206 is thus separable from the busbar connector 202 allowing separable and repeatable mating of the power cable connector 206 with the busbar connector 202.

In an exemplary embodiment, a power connector 298 is terminated to the cable 210 proximate to the second end 234 of the cable 210. The cable 210 is flexible between the power connector 298 and the housing 208. The cable 210 may have any length between the power connector 298 and the housing 208. Having the cable 210 flexible allows the cable 210 to be routed between and/or around other components in the system.

Figure 10:
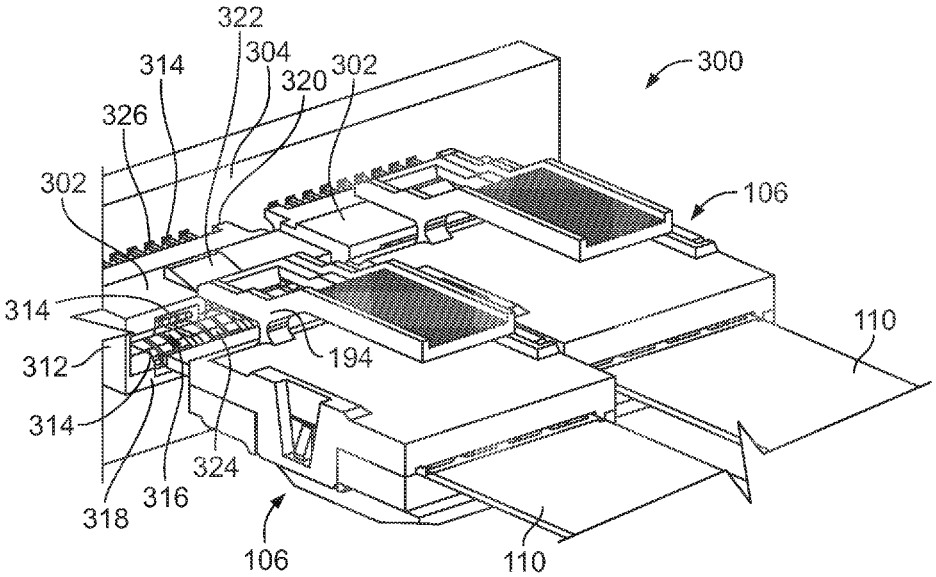
FIG. 10 is a rear perspective view of power cable connectors coupling to a pair of socket connectors in an exemplary power connector system.

FIG. 10 illustrates a power connector system 300 formed in accordance with an exemplary embodiment. The power connector system 300 includes socket connectors 302 mounted to a substrate 304. Any number of socket connectors 302 may be provided. In the illustrated embodiment, the socket connectors 302 are card edge connectors and may be referred to hereinafter as card edge connectors 302. Other types of socket connectors 302 may be used in alternative embodiments. In the illustrated embodiment, the substrate 304 is a circuit board and may be referred to hereinafter as circuit board 304. Other types of substrates 304 may be used to power the socket connector(s) 302.

The power cable connectors 106 are coupled to the card edge connectors 302. Alternatively, the power cable connectors 206 (shown in FIGS. 8 and 9) may be coupled to the card edge connectors 302. Power is transmitted between the circuit board 304 and the cables 110 via the card edge connectors 302. The power cable connectors 106 allows the cables 110 to be coupled directly to the card edge connectors 302 at separable interfaces.

Each card edge connector 302 includes a socket housing 312 holding power terminals 314. The socket housing 312 may hold any number of power terminals 314. The power terminals 314 are electrically connected to the circuit board 304. The power terminals 314 are electrically connected to the cable 110 when the power cable connector 106 is mated with the card edge connector 302.

The socket housing 312 has a socket 316 that receives the power terminals 314 and receives the cable 110. The cable 110 is directly coupled to the power terminals 314 within the socket 316. The power terminals 314 are received in the socket housing 312 and are exposed in the socket 316. The socket 316 is open at a mating end 318 of the socket housing 312. In an exemplary embodiment, the socket 316 has a chamfered lead-in at the mating end 318 for guiding the cable 110 into the socket 316.

The socket housing 312 has a base 320 opposite the mating end 318. The base 320 is configured to be mounted to the circuit board 304. In an exemplary embodiment, the power terminals 314 are loaded into the socket housing 312 through the base 320. The socket housing 312 includes engagement features 322 configured to engage the power cable connector 106 when the power cable connector 106 is mated to the card edge connector 302. In the illustrated embodiment, the engagement features 322 are tabs or projections that extend outward from the socket housing 312. The deflectable latches 194 of the power cable connector 106 are configured to engage the tabs to latchably secure the power cable connector 106 to the socket housing 312.

The power terminals 314 include spring beams 324 that are configured to engage the cable 110 when the cable 110 is loaded into the socket 316. The spring beams 324 are deflectable and are configured to be spring biased against the cable 110 when loaded therein. The power terminals 314 have mounting features 326 for securing the power terminals 314 to the circuit board 304. In the illustrated embodiment, the mounting features 326 constitute compliant pins that are received in plated vias of the circuit board 304. Other types of mounting features may be used in alternative embodiments, such as solder tails.

Figure 11:
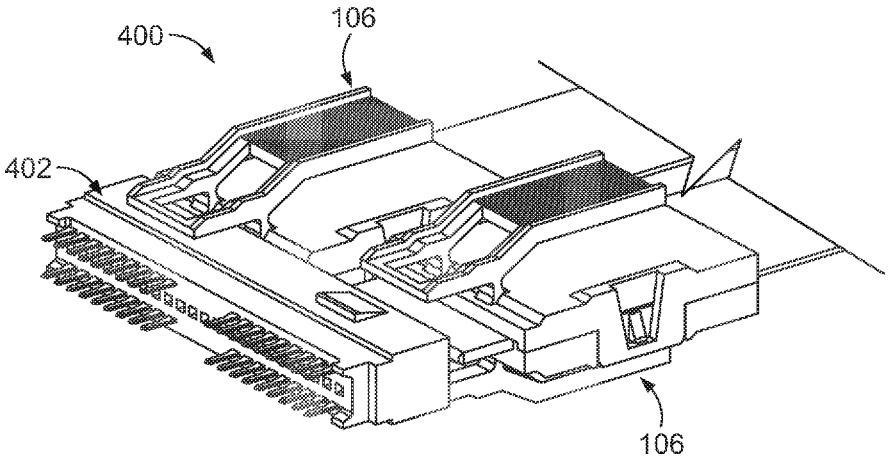
FIG. 11 is a front perspective view of power cable connectors coupling to a single socket connector in an exemplary power connector system.

FIG. 11 illustrates a power connector system 400 formed in accordance with an exemplary embodiment. The power connector system 400 includes a socket connector 402 configured to be mounted to a substrate, such as a circuit board. Any number of socket connectors 402 may be provided. The socket connector 402 may be similar to the socket connectors 302 (shown in FIG. 10), however the socket connector 402 is wider than the socket connectors 302 and is configured to mate with more than one power cable connector 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power cable connector comprising:

a housing having a mating end and a cable end, the housing having an upper shell and a lower shell separate from the upper shell and coupled to the upper shell to form a chamber extending between the mating end and the cable end, the upper shell having a post extending therefrom into the chamber toward the lower shell, the housing having an engagement feature configured to engage a socket connector extending from a substrate; and a flat cable received in the chamber between the upper shell and the lower shell, the flat cable having an opening therethrough receiving the post to secure the flat cable within the chamber, the flat cable extending from the cable end, the flat cable having a mating portion extending from the mating end, the mating portion being configured to be received in the socket connector such that the flat cable is configured to directly engage a power terminal of the socket connector;

wherein the cable is folded over at the mating end to define a first layer and a second layer, at least part of the folded over section of the cable being received in the housing, both the first and second layers including openings aligned with one another, the post of the housing extends through the openings in the first and second layers.

2. The power cable connector of claim 1, wherein the cable includes a first planar surface and a second planar surface, at least one of the first and second planar surfaces engaging the power terminal.

3. The power cable connector of claim 1, wherein the cable is folded over at the mating portion such that the mating portion of the cable is at least twice as thick as the portion of the cable extending from the cable end of the housing, an end of the cable being positioned within the chamber between the upper shell and the lower shell.

4. The power cable connector of claim 1, wherein the cable is flexible.

5. The power cable connector of claim 1, wherein the cable has a rectangular cross-section.

6. The power cable connector of claim 1, wherein the cable has a width and a thickness measured between a first planar surface and a second planar surface, the first and second planar surfaces having substantially similar widths, the width being at least ten times the thickness.

7. The power cable connector of claim 1, further comprising a sleeve covering the portion of the cable extending from the cable end of the housing, the mating end of the cable being uncovered and exposed for direct engagement with the power terminal.

8. The power cable connector of claim 1, wherein the engagement feature comprises a latch configured to latchably secure the housing to the socket connector.

9. The power cable connector of claim 1, wherein the engagement feature comprises an arm extending from the mating end along, and spaced apart from, the mating portion, the arm having a guide slot configured to receive a guide feature of the socket connector to guide mating of the housing and the socket connector.

10. The power cable connector of claim 1, wherein the post extending from the upper shell extends entirely across the chamber through the cable to engage the lower shell, the lower shell comprising a post extending entirely across the chamber through the cable to engage the upper shell, the cable being sandwiched between the upper and lower shells.

11. The power cable connector of claim 1, wherein the housing includes mounting features for mounting the housing to a panel, the housing being movable with the panel for mating and unmating the cable with the socket connector.

12. The power cable connector of claim 1, further comprising a power connector terminated to the cable proximate to an opposite end of the cable from the housing, the cable being flexible between the power connector and the housing.

13. A power connector system comprising:

a socket connector configured to be mounted to a substrate, the socket connector having a socket housing having a socket, the socket connector having a power terminal received in the socket housing and exposed in the socket, the power terminal being configured to be terminated to the substrate; and a power cable connector coupled to the socket connector, the power cable connector comprises a housing having a mating end and a cable end, the housing having a chamber extending between the mating end and the cable end, the power cable connector comprises a flat cable received in the chamber, the flat cable extending from the cable end, the flat cable having a mating portion extending from the mating end, the housing having an upper arm at the mating end extending parallel to and spaced apart above the mating portion of the cable, the housing having a lower arm at the mating end extending parallel to and spaced apart below the mating portion of the cable, the mating portion received in the socket such that the flat cable directly engages the power terminal of the socket connector, the housing being coupled to the socket connector such that the upper arm extends along an exterior of the socket housing and is coupled thereto and the lower arm extends along an exterior of the socket housing and is coupled thereto.

14. The power connector system of claim 13, wherein the cable includes a first planar surface and a second planar surface, at least one of the first and second planar surfaces engaging the power terminal.

15. The power connector system of claim 13, wherein the cable is folded over at the mating portion such that the mating portion of the cable is at least twice as thick as the portion of the cable extending from the cable end of the housing.

16. The power connector system of claim 13, wherein the cable has a width and a thickness measured between a first planar surface and a second planar surface, the first and second planar surfaces having substantially similar widths, the width being at least ten times the thickness.

17. The power connector system of claim 13, wherein the housing includes mounting features for mounting the housing to a panel, the housing being movable with the panel for mating and unmating the cable with the socket connector.

18. A power connector system comprising:

a socket connector configured to be mounted to a substrate, the socket connector having a socket housing having a socket, the socket connector having a power terminal received in the socket housing and exposed in the socket, the power terminal being configured to be terminated to the substrate; and a power cable connector mounted to a panel movable toward and away from the socket connector, the power cable connector comprises a housing having a mating end and a cable end, the housing having a chamber extending between the mating end and the cable end, the housing having an engagement feature engaging the socket connector when the panel is moved toward the socket connector, the power cable connector comprises a flat cable received in the chamber, the flat cable extending from the cable end, the flat cable having a mating portion extending from the mating end, the mating portion received in the socket when the panel is moved toward the socket connector such that the flat cable directly engages the power terminal of the socket connector;

wherein the power cable connector is configured to float with respect to the panel within a floating window.

19. The power connector system of claim 18, wherein the housing includes mounting features for mounting the housing to the panel, the panel being movable in a mating direction, the mounting features being connected to the panel such that the housing is movable with respect to the panel in at least one direction transverse with respect to the mating direction.

* * * * *